US007344004B2

(12) United States Patent
Engel et al.

(10) Patent No.: US 7,344,004 B2
(45) Date of Patent: Mar. 18, 2008

(54) METHOD OF AND APPARATUS FOR OPERATING AN ELEVATOR INSTALLATION IN A COMMISSIONING OPERATION MODE AND AN ACCEPTANCE CHECK MODE

(75) Inventors: Werner Engel, Root (CH); Martin Rogger, Rotkreuz (CH)

(73) Assignee: Inventio AG, Hergiswil NW (CH)

( * ) Notice: Subject to any disclaimer, the term of this patent is extended or adjusted under 35 U.S.C. 154(b) by 609 days.

(21) Appl. No.: 10/925,054

(22) Filed: Aug. 24, 2004

(65) Prior Publication Data

US 2005/0061586 A1 Mar. 24, 2005

(30) Foreign Application Priority Data

Aug. 25, 2003 (EP) ..... 03405615

(51) Int. Cl.
*B66B 1/34* (2006.01)

(52) U.S. Cl. ..... 187/391; 187/247

(58) Field of Classification Search ..... 187/247, 187/391–396, 380, 384; 702/179–185; 340/3.43, 340/3.44
See application file for complete search history.

(56) References Cited

U.S. PATENT DOCUMENTS 4,418,795 A * 12/1983 Trosky et al. ..... 187/391
4,512,442 A * 4/1985 Moore et al. ..... 187/393
4,700,810 A 10/1987 Otala
4,930,604 A * 6/1990 Schienda et al. ..... 187/393
5,257,176 A * 10/1993 Uetani ..... 700/83
5,616,894 A * 4/1997 Nieminen et al. ..... 187/247
6,330,935 B1 * 12/2001 Systermans ..... 187/391
6,984,950 B2 * 1/2006 Jonsson et al. ..... 318/440

FOREIGN PATENT DOCUMENTS

EP 0 366 097 5/1990
EP 0 615 945 9/1994

* cited by examiner

*Primary Examiner*—Jonathan Salata
(74) *Attorney, Agent, or Firm*—Fraser Clemens Martin & Miller LLC; William J. Clemens

(57) ABSTRACT

A method of checking elevator installations with a car, an elevator drive and an elevator controller with a memory avoids or at least reduces errors by a person carrying out the check and enables convenient and reliable checking of the elevator installation. A check program including all steps necessary for the check is set up on the basis of stored configuration data of the elevator installation in the elevator controller and in dependence on a selected mode of operation. In addition, the steps are displayed in a predetennined sequence on an indicating and control unit and necessary inputs for working down the steps are input by way of the indicating and control unit.

28 Claims, 2 Drawing Sheets

ANNOTATED SHEET SHOWING PROPOSED CHANGES

METHOD OF AND APPARATUS FOR OPERATING AN ELEVATOR INSTALLATION IN A COMMISSIONING OPERATION MODE AND AN ACCEPTANCE CHECK MODE

BACKGROUND OF THE INVENTION

The present invention relates to a method of checking elevator installations. In addition, the invention relates to an elevator installation which is provided with a car, an elevator drive and an elevator controller comprising a memory and to which an indicating and control unit is coupled.

Elevator installations have to be checked after their installation or after involved repair measures. In particular, after installing the elevator installation, commissioning of operation is required in which numerous parameters have to be set and an extensive and detailed check of the individual components of the elevator installation is carried out. A series of method steps have to be performed, which must be carried out after the fitting of all mechanical parts and all electrical components in order to place the installation in a state enabling normal operation. Belonging to the essential method steps of the commissioning operation are, inter alia, checking of the mechanical and electrical requirements, activation of the electrical components, checking of the drive, configuring shaft information for determining the position and speed of the elevator car and configuring an elevator controller as well as a device for measuring the car load and the communications interfaces.

After the commissioning of operation the elevator installation has to undergo an acceptance check. The acceptance check is carried out by a person authorized for this activity, i.e. the acceptance examiner, and comprises a series of checks which must be compulsorily undertaken before transfer of the elevator installation to the customer so as to establish whether the installation fulfils the provided specification or whether the legally prescribed guidelines and standards are fulfilled or whether deficiencies exist and, if so, where these are present.

The acceptance check is concluded with creation of an acceptance log which records the results of the checks undertaken. In accordance with legal requirements the acceptance examiner has to be personally responsible for the result of the acceptance check. Various certificates, for example a conformity confirmation, a completion agreement or an acceptance certificate, are made out and have to be personally signed. The acceptance examiner accordingly has a personal interest in gaining a dependable general idea at the location of the elevator installation with regard to all requirements to be checked inclusive of the legal standards and with regard to the relevance of the various results of the acceptance check. In that case the currently usual documentation does not make it easy to obtain this overview in the individual case, especially since details for an elevator type are indeed usually contained in the records, but additionally present are cross-references to other sources, for example to legal standards and specific data sheets for certain components, which have to be separately evaluated.

The concrete steps of commissioning operation and/or acceptance checking of an elevator installation are usually dependent on the specific configuration of the elevator installation. In that case, in particular, the type or series of the elevator installation and the design of the elevator installation with respect to size, power and convenience play a decisive role.

Commissionings of operation and acceptance checks according to a conventional pattern involve effort for the person carrying out the checks and offer many opportunities to make errors which from time to time are overlooked. This is particularly due to the fact that each elevator installation has to be individually constructed and consequently requires individualized checking. Even a fit of elevator installations of the same series in buildings with different building parameters necessitates different measures for commissioning operation and acceptance checking. Further developments of elevator installations require constant adaptation of the measures for commissioning operation and acceptance checking. These further developments are contained in a multiplicity of supplementary documents so that the operation commissioner and the acceptance examiner have to take a number of individual case decisions which depend on the concrete configuration of the elevator, for example the type of elevator, the type of drive used, the type of safety brake used, the layout of the elevator with respect to height of the shaft, the maximum transportable load, the intended maximum speed of the car, etc., in order to determine the appropriate measures for commissioning operation and acceptance checking. With the multiplicity of decision choices, many mistakes can be made particularly due to overlooking details or omission of individual measures.

Moreover, a multiplicity of measurement values have to be detected, wherein further measures have to be selected in dependence on the measurement values, particularly in the case of deviations between actual values and target values. The target values in that case depend in part on several parameters of the elevator configuration and have to be ascertained for each individual case. For example, the action of a safety brake depends on the type of brake and also on other installation parameters, such as, for example, the mass and intended maximum speed of the elevator car or the layout of the guide rails for the car.

In order to undertake commissioning of operation or acceptance checking, comprehensive documentation is necessary which the operation commissioner or acceptance checker has to carry if he or she wants to always be equipped for all possible installation types and configurations of an installation type. If he or she wishes to carry only the absolutely necessary documents of a specific elevator installation it is necessary to make a deliberate selection on each occasion, wherein documents can easily be forgotten or wrong documents selected.

SUMMARY OF THE INVENTION

An object of the present invention is to indicate a method of checking an elevator installation in which errors by a person carrying out a check are avoided or at least reduced. Moreover, such a method shall enable a convenient and reliable acceptance of an elevator installation. Furthermore, the present invention has the object of indicating an elevator installation.

The present invention is based on the concept that data with respect to the specific elevator installation are provided in part already during the installing or relevant parameters for commissioning operation and acceptance checking are known to the manufacturer of the elevator installation. The manufacturer of the elevator installation knows in every case the requisite steps necessary for commissioning operation and acceptance checking of an elevator installation.

Accordingly, it is proposed in accordance with the present invention that for the checking of an elevator installation all necessary steps are determined on the basis of configuration data of the elevator installation in the elevator controller. These configuration data are for that purpose stored in a memory of the elevator installation. On the basis of the determined steps there is then set up a check program which works through the steps in a predetermined sequence. In that case the steps are displayed by the indicating and control unit, wherein inputs, which are required for the individual steps, of parameters of the elevator installation are input by way of the indicating and control unit.

The kind of check is dependent on a selected mode of operation. The setting up of the check program is also dependent on the selected mode of operation. For example, a different check program is required for commissioning operation of an elevator installation than for the acceptance check of an elevator installation already placed in operation. The configuration data of the elevator installation are filed in a memory and identify the elevator installation and configuration thereof in such a manner that all steps to be undertaken for the purpose of the check can be clearly determined from this configuration data. The course of the check program can be established in accordance with the specification of the configuration data. The check program comprises a menu control which leads through the required steps of the check. The investigations, inspections, tests, inputs of parameters, etc., necessary for working down the steps are indicated by way of the indicating and control unit to the person undertaking the check, wherein the required inputs are input by way of the indicating and control unit. The steps required for a check can also comprise a request for checking components of the elevator installation. Requests can also be included to input parameters of, for example, the building or to accurately set components for normal operation. The configuration data can contain target values of parameters, which are indicated on the indicating and control unit. Beyond this, a step can comprise a request to record an actual value of a parameter and to input by way of the indicating and control unit so that the actual value can be compared with the associated target value.

A complete checking of the elevator installation is always undertaken by way of the arrangement according to the invention. Based on the configuration data, an efficient check program is set up which guides the person carrying out the check through the check in the correct sequence with all necessary details. Due to the step-by-step working down, omission of steps is then prevented. This is because the check program allows progress to the next step only when the current step has been successfully worked through. By virtue of the configuration data, a search for optional fitments of the elevator installation can be omitted. Possible further developments of components or new legal regulations are taken into consideration in the configuration data and are thus fundamental to the setting up of the check program. The person carrying out the check does not have to carry comprehensive documentation in order to be equipped for all different configurations of elevator installations. All necessary parameters which have to be checked, set or input in the case of a check are evident from the configuration data.

In one advantageous embodiment of the present invention the check program is worked down by a processor of the elevator controller. The elevator controller usually has the necessary computing power so that the check program can be started on the processor of the elevator controller. However, a processor arranged in the indicating and control unit can also be used for working down the check program. The check can thus be undertaken without the computing power in the elevator controller being influenced. For this purpose the configuration data are transferred to the indicating and control unit so that the check program can be set up there. The check program can, however, also be set up in the elevator controller and then transferred to the processor of the indicating and control unit in order to be worked down there. This is required particularly when the computing power in the elevator controller is limited or is required for other necessary processes in the commissioning of operation. Moreover, a mobile indicating and control unit is of advantage in the checking, since the person carrying out the check has to be at many different positions in the elevator installation or in the elevator shaft in order to perform the check.

In an advantageous embodiment the components incorporated in the elevator installation are initialized in the check according to the invention. This can be carried out by switching on the elevator installation or also by manual activation of the components by the person carrying out the check. It is possible through the initialization to detect the scope of the incorporated components and to derive therefrom and detect the configuration data of the elevator installation and store the data in the memory of the elevator installation. The configuration data of the elevator installation preferably comprise an identification number and/or a list of all components of the elevator installation which have to be taken into consideration in the check. This enables an individual determination of all steps necessary for the check, wherein a unique association is made by way of the identification number and mix-ups are excluded. Moreover, in the check also only the components are checked which were actually installed in the elevator installation, whereby a discovery whether optional components are installed is eliminated.

In an advantageous embodiment of the invention an identity check of the person carrying out the check is undertaken before the start of commissioning operation, wherein the identity check takes place by input of codes or by means of a check card or by means of biometric sensors. A commissioning of operation and/or acceptance check by unauthorized persons is thereby excluded.

In a further advantageous embodiment of the invention a mobile indicating and control unit is connected with the elevator installation, the unit comprising an own memory to which the check program based on the configuration data is transferred. The computing power of the elevator installation is thus not impaired by the check. Moreover, the standard presence of a processor in the indicating and control unit can be utilized for carrying out the check, whereby a menu system based on known operating systems can be used.

In a further advantageous embodiment of the present invention the configuration data of the elevator installation are detected and stored during production. Since the manufacturer of the elevator installation knows all relevant components which must be checked or set depending on the respective operating mode the manufacturer can at the time of construction of an elevator installation determine the configuration data of the elevator installation and store these preferably in the memory of the elevator controller. However, the manufacturer can also file the configuration data on a data carrier or store the data in a service center where the data can be called up in case of need. In the case of storage on a data carrier or in the service center the advantage results that possible further developments of the components or changes in the legal regulations can be incorporated in the configuration data and thus obsolescence of the configuration data stored in the memory of the elevator installation is prevented. Obsolescence of the configuration data can be prevented by, for example, updating of the configuration data by way of a communications connection with the service center.

Equally, it is advantageously possible to detect the configuration data of the elevator installation after installing of the elevator installation and to store the data. In that case a detection program which calls up configuration data of components of the elevator installation is started. It is advantageous in this embodiment if individual configurations resulting during installing of the elevator installation are taken into consideration.

In an advantageous embodiment of the present invention a commissioning operation mode is selected as operating mode. In that case all necessary steps for commissioning of operation are determined on the basis of the configuration data and stored in a memory of the elevator installation. A commissioning operation sequence program, which is started by an operation commissioner, is created by means of the commissioning operation steps. This commissioning operation sequence program works down the commissioning operation steps in a predetermined sequence, wherein the commissioning operation steps are indicated by the indicating and control unit and necessary inputs of parameters of the elevator installation are input by way of the indicating and control unit. Through the selection of the commissioning operation mode there can be set up the commissioning operation sequence program which is selectively adapted to the requisite measures of commissioning operation. A commissioning operation sequence program which is tailored to the special requirements of the elevator installation is set up by the special configuration data of the elevator installation. The operation commissioner thus only has to run through the steps indicated on the indicating and control unit without having to look up specific parameters of the elevator installation.

The commissioning operation steps advantageously comprise a request for connection or checking of components of the elevator installation, a request for input of parameters or a request for undertaking settings of components.

In an advantageous embodiment of the present invention a commissioning operation log is set up after completion of all commissioning operation steps. Thus, the operational commissioner and all interested persons obtain an overview about the checks and settings undertaken during the commissioning of operation. Advantageously the commissioning operation log can be stored in the memory of the elevator installation and/or the memory of the indicating and control unit. This enables a later calling up of the commissioning operation log so that the correctness of the commissioning operation can also be checked at a later point in time. Advantageously after a complete and successful commissioning of operation a commissioned operation status is set which is stored in the memory of the elevator installation. This commissioned operation status enables a fast interrogation with respect to performance of the commissioning operation without having to evaluate the commissioning operation log. Moreover, provision can be made to transfer the commissioning operation log to a service center by way of a communications connection. There the commissioning operation logs of all elevator installations, which have been placed in operation, of a manufacturer can be archived and provided for a later inspection.

In a further advantageous embodiment of the present invention an acceptance check mode is selected in dependence on a commissioned operation status. An acceptance check can be undertaken only when the commissioning of operation of the elevator installation has been carried out. On the basis of configuration data of the elevator installation all necessary acceptance check steps are ascertained in the elevator controller and stored in a memory of the elevator installation. An acceptance check program which is started by an acceptance examiner is set up by means of the acceptance check steps and the acceptance check steps are worked down in a predetermined sequence. In that case acceptance check steps are indicated by the indicating and control unit and necessary inputs of parameters of the elevator installation are input by way of the indicating and control unit. Through selection of the acceptance check mode the necessary steps for the acceptance check, which differ from the steps for the commissioning of operation, can be ascertained. Here too, the configuration data form the basis, so that the acceptance check program is selectively tailored to the specific elevator installation.

In an advantageous embodiment of the present invention an acceptance log is set up, stored and/or transferred to a service center after working through of the acceptance check program. Details of the acceptance check can thus be comprehended at a later date. Moreover, a comparison of parameters of the stored commissioning operation log and the acceptance log can advantageously be undertaken. This serves for further discovery of irregularities or confirmation of a successful commissioning of operation. Through storage of the logs it is possible in the case of maintenance operations at a elevator installation or in the case of modernizations to call up the electronic logs of the commissioning operation and/or the acceptance check with the help of the indicating and control unit and in a given case to appropriately update the current state of the elevator installation.

In an advantageous embodiment of the present invention the acceptance log can be electronically signed by the acceptance examiner or the commissioning operation log can be electronically signed by the operation commissioner. Since the person carrying out the check has to be identified before start of the checking, a signature, which is tied to a person, of the produced logs or certificates can take place by means of this identification, whereby the person responsible for the commissioning of operation or acceptance check can also be ascertained at a later date.

Since corresponding certificates have to be produced for the acceptance check, in an advantageous embodiment of the invention after conclusion of the successful acceptance check an acceptance certificate is issued so that the acceptance checker does not have to carry out any additional written work. A certificate in that case can be issued only when the acceptance check program has been completely and successfully run through.

In an advantageous embodiment of the present invention the indicating and control unit can be used as controller for test runs of components. Comprehensive tests of individual components of the elevator installation can be required in the steps of the check program. The test runs in that case can be controlled by inputs of the indicating and control unit, wherein test results are detected and compared by the indicating and control unit.

The elevator installation according to the present invention comprises a car, an elevator drive and an elevator controller which comprises a memory in which data for performance of commissioning of operation and/or acceptance checking can be stored. The elevator controller is switchable into a commissioning operation mode or an acceptance check mode or a normal mode and is coupled with an indicating and control unit for exchange of data. The indicating and control unit is provided for indicating a system state of the elevator installation, of fault reports and/or of steps for commissioning operation and/or acceptance checking and enables an input of data for control of the commissioning of operation and/or the acceptance check of the elevator installation.

In the case of such an elevator installation the data substantially required for carrying out the commissioning of operation and/or the acceptance check of a specific elevator installation are integrated and stored in the controller of the elevator installation. On the basis of these data all steps to be performed for commissioning operation or acceptance checking are ascertained and stored in a program-controlled manner not only for commissioning operation, but also for acceptance checking. The steps can be run through in a menu-controlled manner by a check program for the purpose of commissioning operation and/or acceptance checking by an authorized person. In that case target values can be indicated by the check program, and measurement data detected and in a given case compared with the target values. The elevator controller can also itself be configured by the program system. All measures undertaken in the commissioning of operation and/or the acceptance check can be detected, checked for completeness and correctness and stored in one or more data files.

In an advantageous embodiment of the present invention the indicating and control unit is integrated in the elevator installation. The resources of the elevator installation can thereby be utilized without having to connect additional apparatus with the elevator installation.

In an alternative embodiment of the present invention the indicating and control unit is constructed to be mobile and connectable with the elevator installation. In this connection, the resources of the elevator installation are not loaded by additional tasks. The indicating and control unit can be readily adapted to increasing demands without the elevator installation having to be changed. A notebook computer can, for example, be used as the indicating and control unit. The indicating and control unit can then be connected with the elevator installation by way of communications connections via wire or on a radio or infrared basis and can communicate with the elevator installation. The form of connection can thus be adapted to requirements. In that case it is advantageous if the indicating and control unit comprises a memory. In this way the amount of data which has to be exchanged between elevator installation and indicating and control unit can be reduced.

According to the present invention the memory in the elevator installation and/or the memory of the indicating and control unit contains programs and/or data serving for interactive control of the course of the commissioning of operation and/or the acceptance checking. The advantage is thereby produced that the sequence of the checks can be automatically generated without essential steps being forgotten.

In an advantageous embodiment of the present invention the elevator installation comprises a communications unit by way of which a communications connection with a service center can be established. The elevator installation is thus in a position of receiving data from a service center or sending data to the center.

In an alternative embodiment of the present invention the indicating and control unit comprises a communications unit by way of which a communications connection with the service center can be established directly between the indicating and control unit and the service center or indirectly by way of a communications connection between the elevator installation and the service center. Updates of the programs and/or data for interactive control of the sequence of the commissioning of operation and/or the acceptance checking or commissioning operation logs and/or acceptance check logs can be transferred to the service center by way of the communications connection.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
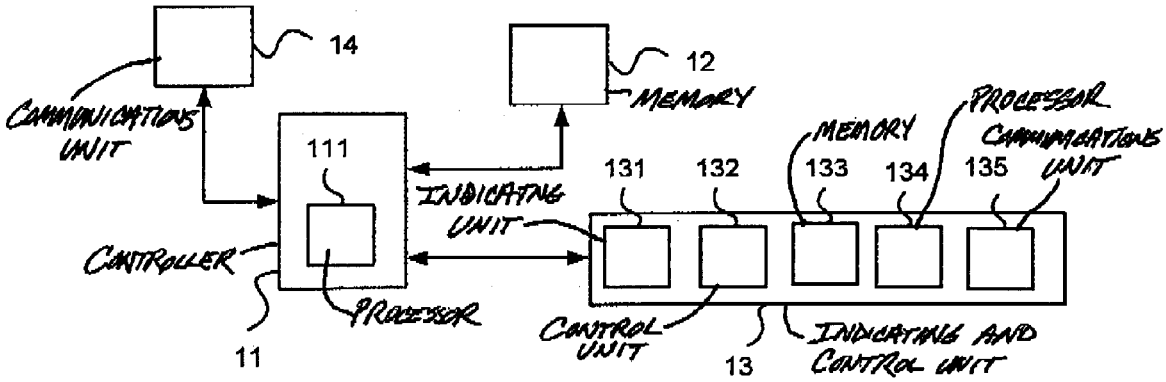
FIG. 1 is a schematic layout of an elevator controller of an elevator installation according to the present invention.

The construction of an elevator installation is illustrated in FIG. 1 in schematic form. The elevator installation is provided with an elevator controller 11 that comprises a processor 111. A memory 12 and a communications unit 14 are connected with the elevator controller 11. The elevator controller 11 is connected with an indicating/display and control unit 13. The display and control unit 13 comprises an indicating unit 131, a control unit 132 and a memory 133. In addition, a processor 134 and a communications unit 135 are arranged in the display and control unit 13.

Configuration data of the elevator installation are stored in the memory 12. Depending on a selected operating mode, steps necessary for checking the elevator installation are determined by the processor 111 of the elevator controller 11. By means of these steps there is set up by the processor 111 a check program which guides a person, who carries out the check, in a menu-controlled manner through all steps of the check. For this purpose the steps are displayed on the indicating unit 131 and correspondingly required inputs are input at the control unit 132. Depending on the respective embodiment the check program can be worked down in the processor 111 of the elevator controller 11, wherein all necessary data for display at the indicating unit 133 and also all inputs at the control unit are transferred to the processor 111 of the elevator controller 11. Alternatively, the check program can also be executed by the processor 134 of the display and control unit 13, wherein the configuration data are stored in the memory 133 of the display and control unit 13. By way of the communications unit 135 of the display and control unit 13 a communications connection with a service center (not illustrated) can be established, by way of which data can then be exchanged. Alternatively, the communications unit 14 of the elevator installation can also be used for establishing a communications connection with a service center. The elevator installation has as standard the communications unit 14 in order to place, for example, emergency calls at a fault center in the case of faults.

Figure 2:
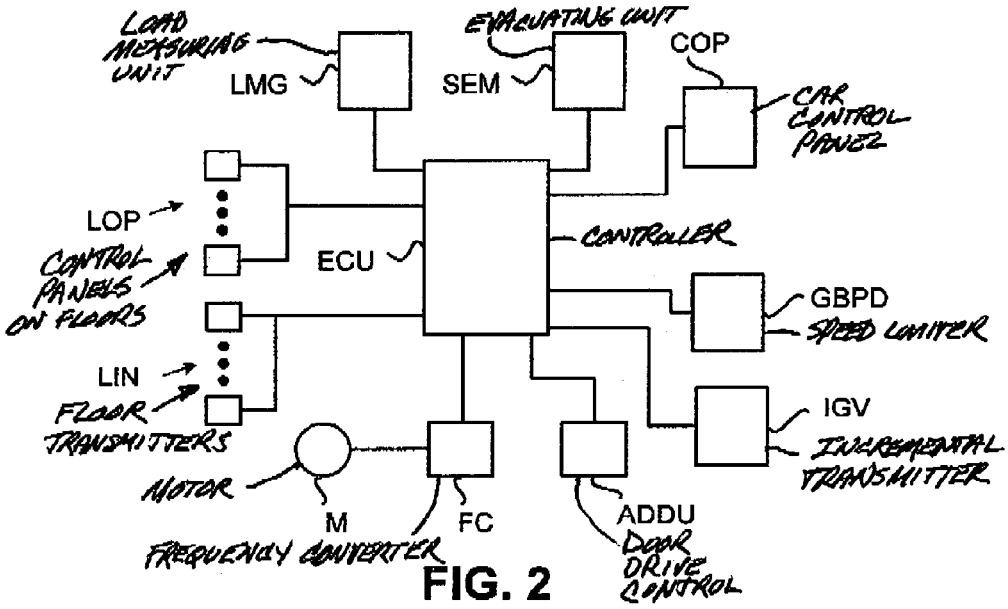
FIG. 2 is a block diagram of the components of the elevator installation of FIG. 1 and connections thereof with the elevator controller.

An elevator controller ECU with which the different components of an elevator installation are connected is illustrated in FIG. 2. The elevator controller ECU is connected with a frequency converter FC and a motor M. In addition, a door drive controller ADDU is connected to the ECU. Control commands are transferred to the elevator controller ECU by way of control panels LOP on individual floors. In addition, a car control panel COP is arranged in a car (not illustrated), the panel similarly serving for indication of data and for control of the elevator and being connected with the elevator controller ECU. In order to recognize the position of the car, floor transmitters LIN are arranged in the elevator shaft. Moreover, a load measuring instrument LMG, which is provided for safety reasons and which serves for positioning of the car at the disembarkation positions at the floors, is connected with the elevator controller ECU. A speed limiter GBPD is connected with the controller ECU and controls the speed of the car in the case of movement in an elevator shaft. For ascertaining the car movement an incremental transmitter IGV is, moreover, connected with the elevator controller ECU. In this example of embodiment an evacuation unit SEM is connected with the elevator controller ECU, wherein this component is optional and is not incorporated in every elevator.

Figure 3:
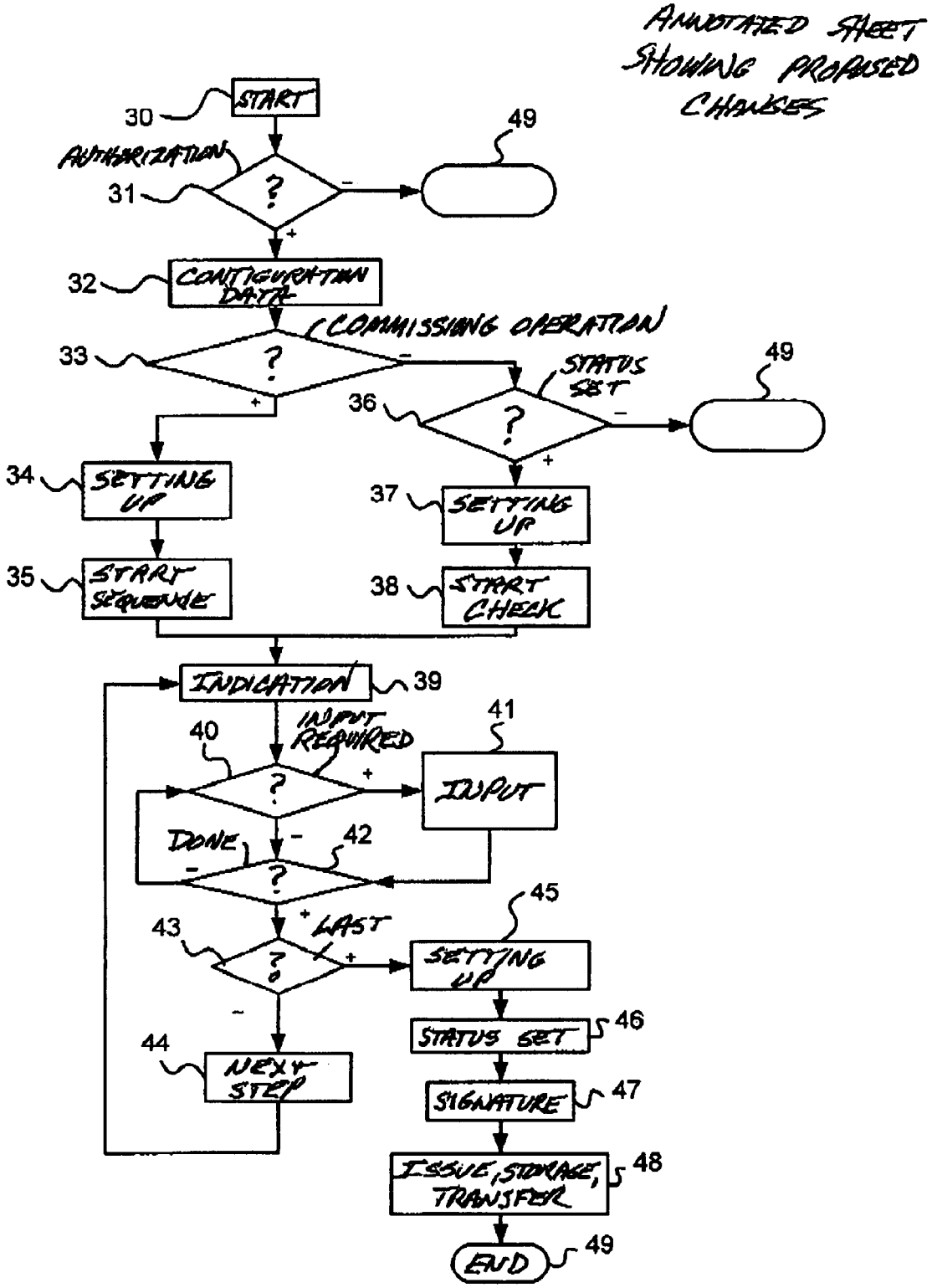
FIG. 3 is a flow diagram of a method according to the present invention for carrying out a check of the elevator installation.

FIG. 3 shows a flow chart for a method of checking the elevator installation in accordance with the present invention. The rhombi in this flow chart indicate respective questions which can be answered by "yes" or "no". The arrows characterized by "+" indicate the respective next step in the case of the answer "yes" and the arrows characterized by "−" denote the next step in the case of the answer "no". The method is started at a step 30. The authorization of the person is then called up in a step 31. In the case of lack of authorization, the method is concluded (branch at "−" to a step 49). If an authorization is present (branch at "+"), the configuration data of the elevator installation are, depending on the respective form of embodiment, called up from a memory, interrogated by means of a program or supplied externally by means of a data carrier or by way of a communications connection in a step 32. In a step 33 the input operating mode is interrogated. If commissioning of operation is to be carried out (branch at "+"), the method progresses with a step 34. If an acceptance check is to be carried out (branch at "−"), it is initially checked in a step 36 whether the elevator installation has already been placed in operation. The method is otherwise concluded (branch at "−" to the step 49). In this flow chart only the input of two different operating modes is possible. If the commissioning operation mode was selected, there is set up in the step 34 a commissioning operation sequence program which comprises all steps required for commissioning operation of the elevator installation with the specific configuration data from the step 32. In a step 35 this commissioning operation sequence program is started.

If the acceptance check mode was selected, there is set up in a step 37 an acceptance check program which comprises all steps required for acceptance checking of the elevator installation with the specific configuration data from the step 32. This acceptance check program is started in a step 38. Independently of which of the two possible check programs was started, the required steps are displayed on the indicating and control unit 13 in a step 39. In that case it is checked in a step 40 whether input of a parameter is required. If this is required (branch at "+"), this input is put in by way of the control unit 132 in a step 41. The method remains in this loop until the step for commissioning operation or for acceptance of corresponding components is worked through (branch "+" from a step 42). It is next checked in a step 43 whether the last step of the check program was worked through. If the last step of the started check program has still not been worked through (branch "−"), the respective next step of the check program is worked through (a step 44). If the last step of the started check program has been reached (branch "+"), the associated log is set up depending on the respective check program (a step 45). With the precondition that the check program was successfully worked down, the corresponding status of the check is set (a step 46). This is the commissioned operation status in the case of commissioning operation and an acceptance checked status in the case of acceptance checking. After the corresponding status has been set, the corresponding log is signed in a step 47. Thereafter the corresponding log or, in a given case, a certificate for the acceptance check is issued in a step 48, stored and optionally transferred to a data carrier or by way of a communications connection. The method then terminates in the step 49.

Individual components of the elevator installation are described by way of example in the following, wherein the steps required for the commissioning operation or the acceptance checking are shown.

In the case of the commissioning operation, initially the mechanical requirements are checked. Belonging to this is a check whether all mechanical parts have been completely mounted. In particular the safety brake equipment, the travel brake, the car door and the shaft doors are checked. A check of the electrical components is thereafter carried out. This comprises checking whether corresponding cable connections, for example between the elevator controller ECU and the door drive controller ADDU, have been mounted, wherein these are still not, however, connected. It is checked whether the shaft wiring has been completely finished and connected with the door locks and floor control panels LOP. The transmission wiring and the connections at the motor are checked. In addition, the car position in the shaft is checked, wherein the car shall be positioned at the last floor. In a next step the electrical connections of the individual components are carried out in a predetermined sequence. This requires precise knowledge of the kind of connections and the connection positions. After all electrical components have been connected and coupled with the corresponding controllers, the configuration of the elevator installation is checked. In that case switch positions must be checked or set, wherein here too the correct sequence has to be followed and correct positions of the switches set. For example, in the case of presence of an evacuating unit several connections and switch positions at the elevator controller are carried out differently than if the elevator installation does not have an evacuating unit.

After all connections and switches at the elevator controller have been connected or positioned, the switches have to be set and connections undertaken at a control unit at the car. When all cables connections have been connected and all switches have their predetermined position the elevator installation is activated. For that purpose a mains current cable has to be plugged in and thermal magnets and differentials switched on. After the activation, the phase positions of the motors are, for example, checked. If these are not to specification, a series of steps must be undertaken until the phase position agrees. Moreover, a plurality of control LEDs at various components at different positions in the elevator or in the elevator shaft is checked.

With the presumption that all steps were worked down successfully beforehand, the individual functions of the components are checked in the following. If all components function in accordance with specification, a first inspection travel by the elevator is undertaken, in which the different control commands are given, the effect of which has to be checked. The elevator is then moved at high speed for the first time. In addition, in this connection the sequence of control commands must be followed. In the case of these tests (synchronization travel, learning travel) the elevator is synchronized, i.e. it is set that the elevator stops at the correct positions at the floors. After these tests the floor control panels are parameterized. For that purpose, depending on the respective floor the corresponding numbers must be indicated on displays of the floor control panels. This has to be programmed for each floor. In addition, the elevator load cell is calibrated. The elevator load cell is set to predetermined parameters. The operation commissioner must check whether these parameters lie in the predetermined tolerance range. For that purpose the car has to be loaded with defined loads and moved, wherein different distance measurements are recorded and input. It must also be set how long the doors remain open, when a car fan is switched on, etc. In addition, the communications unit 14 at the elevator installation is configured. For that purpose the communications unit 14 has to be connected with a telephone connection and appropriate telephone numbers of the fault center programmed. In addition, the intercom in the car is set and tested.

In the case of the acceptance check, similarly switch settings must be checked, distances measured, labels checked or applied, lights tested at different locations, safety symbols checked, the communications unit tested, accesses to the shaft checked and secured and floor door locks specified. Particularly important is the check whether all safety-relevant components and systems, for example the safety brake devices for a car and the safety contacts and safety circuits for monitoring the elevator installation, satisfy the requisite legal standards or prescriptions. Moreover, a series of distances is recorded and compared with target values. The car type, the guide rails and the rail fastenings have to be specified. Furthermore, the weight of the empty car is detected and tested. The functions of the car are checked, particularly an overload device which prevents normal start-up in the case of excessive weight. The emergency escape hatch in the car must be checked. Spacings of the car from the shaft, the door spacing and the spacing of the car from the door threshold are detected and compared with target values. An important point in the acceptance check is formed by checking the cables, wherein cable parameters, such as number and diameter, are detected and checked. In addition, the anchorage of the cables at the car and at the drive is checked. Markings at a speed limiter cable must also be checked. As a next point in the acceptance check the motors and components thereof are checked and tested. Belonging thereto is, for example, a temperature monitoring of the drive motor, the door drive motors and the frequency converter. The running time of a motor running time limiter must be checked. Next the electrical wirings are checked. Belonging to that is checking of the grounding, the insulation resistance and the electrical wiring also with respect to an EMV measurement. The acceptance examiner must check whether documents required for the operation, such as registration book and instruction handbook, are available. Finally, a series of forms must be filled out.

The above listing of the actions with respect to the commissioning operation and the acceptance checking make clear how complex checks of that kind are. The method according to the present invention for carrying out checks facilitates checking for the person carrying out the check, wherein the checking according to the present invention at the same time produces an improvement with respect to completeness and safety.

Through the configuration data from which every point for commissioning operation and acceptance checking can be derived, the selected form of checking can be carried out in menu-controlled manner by way of the display and control unit 13. The operation commissioner can set, compare or adjust all parameters of the elevator controller in readily comprehensible manner.

In the case of use of a mobile display and control unit 13 which is connected with the elevator installation there can also be used for the method according to the present invention a divided system for producing a check program. Since acceptance checks and the commissioning of operation elapse in steps which are also basically the same for different elevator installations, these steps of the check program can be stored in the indicating and control unit. The installation-specific detail aspects, thereagainst, depend very strongly on the configuration of a specific elevator installation. Thus, the part of the check program which is independent of the concrete configuration of an elevator installation and the data about the sequence of checking can be stored in the indicating and control unit 13 as a menu structure. The details are then inserted from the configuration data of the specific installation into this menu structure so that the steps of the check program are made specific by these configuration data.

Through the program-controlled working down not only of the commissioning of operation, but also the acceptance checking the checks are more convenient and safe. Beyond that, the expenditure of time for the checks is optimized. The person carrying out the check can concentrate entirely on checking the elevator installation without having to constantly look up technical documents. Moreover, the transport of a mobile display and control unit 13 for the checking of an elevator installation is more convenient than carrying numerous documents, particularly since the person carrying out the check in the case of large elevator installations has to also move about a lot and work at inaccessible positions.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of checking an elevator installation having an elevator controller connected with an indicating and control unit, the method comprising the steps of:

a) setting up in the elevator controller a check program comprising all steps necessary for the check on the basis of configuration data of the elevator installation and for at least one of a commissioning operation and an acceptance check;

b) selectively switching the elevator controller into a commissioning operation mode, an acceptance check mode and a normal operation mode;

c) displaying the steps of the check program in a predetermined sequence on a display and control unit; and d) inputting into the display and control unit inputs necessary for performing the steps of the check program.

2. The method according to claim 1 wherein the check program steps are performed by at least one of a processor of the elevator controller and a processor of the display and control unit.

3. The method according to claim 1 wherein during the performing of the steps of the check program, components incorporated in the elevator installation are initialized, and through the initialization of the components configuration data of the elevator installation are detected and stored in at least one of a memory of the elevator installation and a memory of the display and control unit.

4. The method according to claim 3 wherein the configuration data of the elevator installation is at least one of an identification number and a list of all of the components of the elevator installation.

5. The method according to claim 1 wherein that before the performing of the steps of the check program an identity of a person to carry out the check is checked, wherein the identity check is carried out by at least one of input of a code, a chip card and biometric sensors.

6. The method according to claim 1 including connecting the display and control unit with the elevator installation and transferring to a memory of the display and control unit the check program and configuration data of components of the elevator installation.

7. The method according to claim 6 wherein the configuration data of the elevator installation is detected and stored during manufacture of the elevator installation.

8. The method according to claim 6 wherein the configuration data of the elevator installation is detected and stored after installing the elevator installation, wherein a detection program which calls up the configuration data of the components of the elevator installation is started.

9. The method according to claim 1 wherein configuration data of the elevator installation are transferred to at least one of a memory of the elevator controller and a memory of the display and control unit by transfer from a service center.

10. The method according to claim 1 wherein a program for setting up the check program is stored in the display and control unit and sets up the check program on the basis of supplied configuration data of the elevator installation.

11. The method according to claim 1 including providing configuration data containing target values of parameters which are displayed on the display and control unit, detecting actual values of the parameters input into the display and control unit and comparing the actual values with the target values.

12. The method according to claim 1 including selecting the commissioning operation mode, determining all necessary commissioning operation steps and storing the commissioning operation steps in a memory of the elevator installation, using the commissioning operation steps to set up a commissioning operation sequence program which is started by an operation commissioner, performing the commissioning operation steps in a predetermined sequence, displaying the commissioning operation steps on the display and control unit, and inputting necessary inputs of parameters of the elevator installation into the display and control unit.

13. The method according to claim 12 wherein the commissioning operation steps include a request for at least one of connection and checking of components of the elevator installation, and a request for at least one of input of parameters and undertaking settings of the components.

14. The method according to claim 12 wherein after completion of all commissioning operation steps at least one of the following steps is performed: a commissioning operation log is set up and stored in a memory of the elevator installation; the commissioning operation log is set up and stored in a memory of the display and control unit; a commissioned operation status is set in the memory of the elevator installation; and the commissioning operation log is set up and transferred to a service center by a communications connection.

15. The method according to claim 14 including selecting the acceptance check mode in dependence on the commissioned operation status, determining all necessary acceptance check steps on the basis of configuration data of the elevator installation in the elevator controller, storing the acceptance check steps in the memory of the elevator installation, using the acceptance check steps to set up an acceptance check program which is started by an acceptance examiner, performing the acceptance check steps in a predetermined sequence, displaying the acceptance check steps on the display and control unit, and inputting necessary inputs of parameters of the elevator installation into the display and control unit.

16. The method according to claim 15 wherein after performing the acceptance check program an acceptance log is set up and at least one of stored and transferred to a service center.

17. The method according to claim 16 including performing a comparison of the parameters of the stored commissioning operation log and the parameters of the acceptance log.

18. The method according to claim 16 wherein the acceptance log is electronically signed by the acceptance examiner and the commissioning operation log is electronically signed by the operation commissioner.

19. The method according to claim 16 wherein certificates are produced and issued on the basis of the acceptance log.

20. An elevator installation having a car, an elevator drive moving the car and an elevator controller operating the car and the drive, comprising:

a controller memory in which data for performance of at least one of a commissioning operation and an acceptance check is stored;

means for selectively switching the elevator controller into a commissioning operation mode, an acceptance check mode and a normal mode of operation; and a display and control unit adapted to be connected to the elevator controller for exchange of data, whereby said display and control unit displays at least one of a system state of the elevator installation, fault reports, steps for the commissioning operation and steps for the acceptance check, and whereby said display and control unit can input data for control of the commissioning operation and the acceptance check to the elevator installation.

21. The elevator installation according to claim 20 wherein said display and control unit is integrated in the elevator installation.

22. The elevator installation according to claim 20 wherein said indicating and control unit is releasably connectable with the elevator installation and includes a memory for storing at least one of the commissioning operation and the acceptance check.

23. The elevator installation according to claim 22 wherein said display and control unit communicates with the elevator installation by at least one of a wire connection, a radio communication and an infrared communication.

24. The elevator installation according to claim 20 wherein at least one of said controller memory and a memory of said display and control unit interactively controls a sequence of at least one of the commissioning operation and the acceptance check.

25. The elevator installation according to claim 20 including a communications unit adapted to be connected to the elevator controller by which a communications connection with a service center can be established.

26. The elevator installation according to claim 25 wherein said display and control unit includes said communications unit and the communications connection with the service center is established by at least one of directly between said display and control unit and the service center and indirectly by way of a communications connection between the elevator installation and the service center.

27. The elevator installation according to claim 25 wherein said communications connection is adapted to transfer from the service center at least one of updates for interactive control of the sequence of the commissioning operation, updates for interactive control of the sequence of the acceptance check, commissioning operation logs, and acceptance check logs.

28. A method of checking an elevator installation having an elevator controller connected with an indicating and control unit, the method comprising the steps of:

a) setting up in the elevator controller a check program comprising all steps necessary for the check on the basis of configuration data of the elevator installation and in dependence on the selected operating mode;

b) displaying the steps of the check program in a predetermined sequence on a display and control unit;

c) inputting into the display and control unit inputs necessary for performing the steps of the check program;

d) selecting a commissioning operation mode;

e) determining all necessary commissioning operation steps and storing the commissioning operation steps in a memory of the elevator installation;

f) using the commissioning operation steps to set up a commissioning operation sequence program which is started by an operation commissioner;

g) performing the commissioning operation steps in a predetermined sequence;

h) displaying the commissioning operation steps on the display and control unit; and i) inputting necessary inputs of parameters of the elevator installation into the display and control unit.

* * * * *